US008756755B2

(12) United States Patent
Molnar et al.

(10) Patent No.: US 8,756,755 B2
(45) Date of Patent: Jun. 24, 2014

(54) VACUUM CLEANER

(75) Inventors: Gergely Molnar, Budapest (HU); Gábor Kiss, Budapest (HU); László Soós, Budapest (HU)

(73) Assignee: AB Electrolux (SE)

( * ) Notice: Subject to any disclaimer, the term of this patent is extended or adjusted under 35 U.S.C. 154(b) by 855 days.

(21) Appl. No.: 12/863,333

(22) PCT Filed: Jan. 15, 2009

(86) PCT No.: PCT/SE2009/000013
§ 371 (c)(1),
(2), (4) Date: Jan. 24, 2011

(87) PCT Pub. No.: WO2009/091316
PCT Pub. Date: Jul. 23, 2009

(65) Prior Publication Data

US 2011/0107550 A1 May 12, 2011

Related U.S. Application Data

(60) Provisional application No. 61/078,644, filed on Jul. 7, 2008.

(30) Foreign Application Priority Data

Jan. 16, 2008 (SE) ..... 0800103

(51) Int. Cl.
*A47L 9/10* (2006.01)

(52) U.S. Cl.
USPC ..... 15/352; 15/347

(58) Field of Classification Search
USPC ..... 15/352, 327.1, 347, 348, 349, 350, 351
See application file for complete search history.

(56) References Cited

U.S. PATENT DOCUMENTS

| | | | |
|---|---|---|---|
| 458,773 | A | 9/1891 | Lee |
| 941,675 | A | 11/1909 | Green |
| 963,139 | A | 7/1910 | Griffiths |
| 1,029,562 | A | 6/1912 | Prentiss |
| 1,133,543 | A | 3/1915 | Duffie |
| 1,507,271 | A | 9/1924 | Bennett |
| 1,508,315 | A | 9/1924 | Brockway |
| 1,565,318 | A | 12/1925 | Fisher |

(Continued)

FOREIGN PATENT DOCUMENTS

| | | |
|---|---|---|
| EP | 0 489 565 | 6/1992 |
| EP | 0 885 585 | 12/1998 |

(Continued)

OTHER PUBLICATIONS

"Unconventional cyclone separators" by P. Schmidt, International Chemical Engineering, vol. 33, No. 1, Jan. 1993, pp. 8-17.

(Continued)

*Primary Examiner* — Lee D Wilson
*Assistant Examiner* — Joel Crandall
(74) *Attorney, Agent, or Firm* — RatnerPrestia

(57) ABSTRACT

A vacuum cleaner having a main body and a dust collecting bin, the dust collecting bin is removably mounted in a mounting portion of the main body.

13 Claims, 8 Drawing Sheets

(56) References Cited

U.S. PATENT DOCUMENTS

| | | | |
|---|---|---|---|
| 1,871,111 | A | 8/1932 | Campbell |
| 2,118,167 | A | 5/1938 | Connor |
| 2,193,479 | A | 3/1940 | Donaldson |
| 2,375,608 | A | 5/1945 | Young |
| 2,482,166 | A | 9/1949 | Gage |
| 2,934,494 | A | 4/1960 | Kleiber |
| 3,543,325 | A | 12/1970 | Hamrick |
| 3,626,545 | A | 12/1971 | Sparrow |
| 3,853,518 | A | 12/1974 | Tu |
| 4,108,778 | A | 8/1978 | Lambert |
| 4,593,429 | A | 6/1986 | Dyson |
| 4,678,588 | A | 7/1987 | Shortt |
| 4,853,008 | A | 8/1989 | Dyson |
| 4,944,780 | A | 7/1990 | Usmani |
| 5,078,761 | A | 1/1992 | Dyson |
| 5,080,697 | A | 1/1992 | Finke |
| 5,106,488 | A | 4/1992 | Jonasson |
| 5,135,552 | A | 8/1992 | Weistra |
| 5,160,356 | A | 11/1992 | Dyson |
| 5,230,722 | A | 7/1993 | Yonkers |
| 5,248,323 | A | 9/1993 | Stevenson |
| 5,287,591 | A | 2/1994 | Rench |
| 5,307,538 | A | 5/1994 | Rench |
| 5,350,432 | A | 9/1994 | Lee |
| 5,725,623 | A | 3/1998 | Bowerman |
| 5,779,745 | A | 7/1998 | Kilstrom |
| 5,840,103 | A | 11/1998 | Dyson |
| 5,853,440 | A | 12/1998 | Dyson |
| 5,858,038 | A | 1/1999 | Dyson |
| 5,893,936 | A | 4/1999 | Dyson |
| 5,914,416 | A | 6/1999 | Thode |
| 5,935,279 | A | 8/1999 | Kilstrom |
| 5,950,274 | A | 9/1999 | Kilstrom |
| 6,003,196 | A | 12/1999 | Wright |
| 6,026,540 | A | 2/2000 | Wright |
| 6,070,291 | A | 6/2000 | Bair |
| 6,079,079 | A | 6/2000 | Oka |
| 6,085,382 | A | 7/2000 | Bobrosky |
| 6,141,826 | A | 11/2000 | Conrad |
| 6,192,550 | B1 | 2/2001 | Hamada |
| 6,238,451 | B1 | 5/2001 | Conrad |
| 6,260,234 | B1 | 7/2001 | Wright |
| 6,269,518 | B1 | 8/2001 | Yung |
| 6,332,239 | B1 | 12/2001 | Dubos |
| 6,334,234 | B1 | 1/2002 | Conrad |
| 6,341,404 | B1 | 1/2002 | Salo |
| 6,350,292 | B1 | 2/2002 | Lee |
| 6,375,696 | B2 | 4/2002 | Wegelin et al. |
| 6,385,810 | B1 | 5/2002 | Lang |
| 6,513,190 | B1 | 2/2003 | Allgeier et al. |
| 6,558,453 | B2 | 5/2003 | Sepke |
| 6,589,309 | B2 | 7/2003 | Oh et al. |
| 6,596,045 | B2 | 7/2003 | Qian |
| 6,640,385 | B2 | 11/2003 | Oh et al. |
| 6,732,406 | B2 | 5/2004 | Oh |
| 6,735,816 | B2 | 5/2004 | Oh et al. |
| 6,735,818 | B2 | 5/2004 | Hamada et al. |
| 6,757,933 | B2 | 7/2004 | Oh et al. |
| 6,782,584 | B2 | 8/2004 | Choi |
| 6,829,804 | B2 | 12/2004 | Sepke |
| 6,836,931 | B2 | 1/2005 | Bone |
| 6,910,245 | B2 | 6/2005 | Hawkins et al. |
| 6,922,868 | B1 | 8/2005 | Jeong |
| 6,991,667 | B2 | 1/2006 | Yang et al. |
| 7,055,211 | B2 | 6/2006 | Tucker |
| 7,134,164 | B2 | 11/2006 | Alton |
| 7,152,274 | B2 | 12/2006 | Alford et al. |
| 7,155,772 | B2 | 1/2007 | Lee |
| 7,191,490 | B2 | 3/2007 | Lee et al. |
| 7,377,010 | B2 | 5/2008 | Harsh et al. |
| 7,444,712 | B2 * | 11/2008 | Wiedemann ..... 15/352 |
| 7,578,027 | B2 * | 8/2009 | Kim ..... 15/352 |
| 2002/0029436 | A1 | 3/2002 | Hawkins |
| 2002/0104185 | A1 | 8/2002 | Weber et al. |
| 2003/0140449 | A1 | 7/2003 | Alton |
| 2003/0159240 | A1 | 8/2003 | Mertes et al. |
| 2004/0148723 | A1 | 8/2004 | Roney et al. |
| 2004/0148731 | A1 | 8/2004 | Damman et al. |
| 2004/0261216 | A1 | 12/2004 | Choi et al. |
| 2005/0138760 | A1 | 6/2005 | Park et al. |
| 2005/0138761 | A1 | 6/2005 | Park et al. |
| 2005/0138763 | A1 | 6/2005 | Tanner et al. |
| 2006/0117520 | A1 | 6/2006 | Choi |
| 2006/0123589 | A1 | 6/2006 | Kim |
| 2006/0272122 | A1 | 12/2006 | Butler et al. |
| 2007/0011842 | A1 | 1/2007 | Moon |
| 2007/0234505 | A1 | 10/2007 | Gordon et al. |
| 2007/0251050 | A1 | 11/2007 | Harsh et al. |
| 2008/0148512 | A1 | 6/2008 | Beskow et al. |
| 2008/0223407 | A1 | 9/2008 | Smith et al. |

FOREIGN PATENT DOCUMENTS

| | | | |
|---|---|---|---|
| EP | 0 966 912 | | 12/1999 |
| EP | 1 157 650 | | 11/2001 |
| EP | 1 199 023 | | 4/2002 |
| EP | 1 669 015 | | 6/2006 |
| EP | 1779758 | A2 | 5/2007 |
| FR | 1468142 | | 12/1966 |
| GB | 1111074 | | 4/1966 |
| GB | 2298598 | | 9/1996 |
| GB | 2367512 | | 4/2002 |
| JP | 54-121568 | | 9/1979 |
| JP | 8-322769 | | 12/1996 |
| SE | 119307 | | 7/1947 |
| WO | WO 99/22873 | | 5/1999 |
| WO | WO 99/22874 | | 5/1999 |
| WO | WO 00/21428 | | 4/2000 |
| WO | WO 00/49932 | | 8/2000 |
| WO | WO 00/64321 | | 11/2000 |
| WO | WO 01/35809 | | 5/2001 |
| WO | WO 02/03844 | | 1/2002 |
| WO | WO 02/03845 | | 1/2002 |
| WO | WO 02/03846 | | 1/2002 |
| WO | WO 2004/026485 | | 4/2004 |
| WO | WO 2004/030508 | | 4/2004 |

OTHER PUBLICATIONS

"Chapter 6: Centrifugal Separators" Industrial Gas Cleaning Second Edition, by W. Strauss, Pergamon Press, 1975, pp. 216-276.

Eureka Lightweight Upright Vacuum Cleaner Owner's Guide 410 Series (.Copyrgt. 2000).

9 pictures of the Eureka Lightweight Upright Vacuum Cleaner 410 Series (.Copyrgt. 2000).

"Cyclone Separator for Vacuum Cleaners" by Per Fonser, Nov. 1995.

Enstaubungstechnik, by Dr. Ing. Wilhelm Batel, 1972.

"Chapter 7: Cyclone Dust Separators" Dust Control and Air Cleaning, by R.G. Dorman, Pergamon Press, pp. 236-279, 1974.

* cited by examiner

VACUUM CLEANER

The present invention claims priority to International Application No. PCT/SE2009/000013 filed Jan. 15, 2009, which claims priority to Swedish Application No. SE 0800103-4 filed Jan. 16, 2008 and U.S. Provisional Application No. 61/078,644 filed Jul. 7, 2008. The entire disclosures of all of the foregoing are incorporated herein by reference.

FIELD OF THE INVENTION

The present invention relates to a vacuum cleaner having a removable dust collecting bin.

BACKGROUND ART

The general principle of a vacuum cleaner is to draw in dust-laden air by using a vacuum force generated by a motor mounted in a main body. The dust is separated from the air and is collected in a dust collecting bin arranged in the main body. The dust collecting bin can for example be a filter bag through which the air is drawn and filtrated, a bin adopting the principle of cyclone, a bin comprising a filter in order to separate and collect the dust. Depending on which principle is used, the filter bag can be removed and replaced by a new one when full, or the dust collecting bin can be removed, emptied and reinserted into the main body. The present invention relates to a vacuum cleaner having a locking mechanism to be used for the latter principle.

Many types of locking mechanisms are known. By way of example EP 1 779 758 A2 discloses the use of a guide recess arranged in the main body engaging a hinged protrusion in the dust collecting bin. U.S. Pat. No. 6,589,309 B2 discloses another embodiment in which the dust collecting bin in its bottom has a slanted recess that spirals outward, gradually increasing in depth. The recess engages a movable lever arranged in the main body which lever has a protrusion engaging the slanted recess.

EP 1 669 015 A1 discloses a vacuum cleaner wherein the dust collecting bin engages a mounting portion in the form of a cavity arranged in the main body. An elastic biasing unit is arranged either in the top or in the bottom of said cavity biasing the bin in the vertical direction. Further, an engagement unit in the form of a circular groove in the mounting portion cooperates with a corresponding rib formed in the bin. The rim engages the groove by the biasing created by the biasing unit. The bin is inserted into the mounting portion by moving the bin in a horizontal direction while at the same time applying a vertical force depressing the biasing unit. When fully inserted in the horizontal direction, the vertically applied force can be released whereby the biasing unit forces the rib into locking engagement with the groove. Thus, the operator must simultaneously apply a force and movement in two directions when inserting or removing the bin. The simultaneous two-directional application of force and movement requires a certain strength and stability of the operator, which can be difficult for people having a limited strength and motor ability, such as children, older people and disabled.

OBJECT OF THE PRESENT INVENTION

Thus, the objects of the present invention is to provide a vacuum cleaner having a simple locking mechanism for a dust collecting bin which can be operated by a one-handed linear movement and force application.

The required force should require no special physical ability of the operator, whereby the locking mechanism can be handled by children and older people as well as by disabled.

Also, said locking mechanism should be easy to integrate and mount in a vacuum cleaner and show a low failure probability

SUMMARY OF THE INVENTION

To achieve at least one of these objects and also other objects that will be evident from the following description, the present invention refers to a vacuum cleaner having a main body and a dust collecting bin, said dust collecting bin being removably mounted in a mounting portion of the main body and having two bin surfaces facing away from each other, and said mounting portion having two receiving surfaces facing each other and a locking means for securing the mounted dust collecting bin. The vacuum cleaner is characterized in that said locking means comprises at least one engaging element arranged in at least one of said receiving surfaces of the mounting portion and projecting therefrom, and said dust collecting bin having at least one recess in at least one of said bin surfaces for receiving said at least one engaging element in the mounted state of the dust collecting bin and said at least one engaging element being retractable allowing insertion and removal of said dust collecting bin by displacement along a first axis and said receiving surfaces of the mounting portion preventing movement of the dust collecting bin along a second axis perpendicular to the first axis.

By the present invention the dust collecting bin can be inserted to or removed from the mounting portion by a one-handed linear force and movement along a first axis. The demands concerning physical ability of the operator are thus highly reduced, both as regards to strength and motor ability.

During this movement, but also once the dust collecting bin is mounted in the mounting portion, the dust collecting bin is prevented from movement in a direction perpendicular to said first axis. It is to be understood that this applies no matter if the receiving surfaces of the mounting portion are parallel or not. This provides for a proper handling during insertion/removal of the dust collecting bin, but also for a proper positioning of the dust collecting bin as regards to the main body and thus the suction source during use of the vacuum cleaner.

Said engaging elements can be retractable upon application of a force by said dust collecting bin along the first axis. Accordingly, the engaging means are operated by the dust collecting bin during insertion and removal of the same.

The engaging elements in said two receiving surfaces facing each other can have different geometries.

At least some of said engaging elements can along the first axis comprise a first guiding surface facing away from the main body and a second guiding surface facing the main body, wherein seen in a horizontal plane the first guiding surface forms an angle to that plane that differs from an angle to that plane formed by the second guiding surface. By the two guiding surfaces facing away from each other the insertion and removal of the bin is facilitated. The linear force required along the first axis to insert/remove the bin is converted by a wedge action between the bin surfaces and the angled guiding surfaces to a linear movement of the engaging elements along a second axis being perpendicular to the first axis. The converted force direction provides retraction of the engaging elements which releases engagement between the bin and the mounting portion. By different angles the force required to insert the bin can be made different to that required to remove the bin. Provided the angle of the first guiding surface is smaller than the angle of the second guiding surface, the force required to insert the bin can be made to be smaller than the force required to remove the bin and vice versa. It is to be understood that the force required is also dependent on the strength of any means pre-tensioning the engaging elements.

The first guiding surface can form an angle of 15-35 degrees in relation to the horizontal plane. Correspondingly, the second guiding surface can form an angle of 30-70 degrees and more preferably 40-50 degrees in relation to the horizontal plane.

At least some of said engaging elements can along the first axis comprise a first guiding surface facing away from the main body and a second guiding surface facing the main body, wherein seen in a horizontal plane the first guiding surface forms an angle to that plane equaling an angle to that plane formed by the second guiding surface. In case the angles formed by the first and second engaging elements in relation to the horizontal plane are the same, said angles can be 30-70 degrees and more preferably 40-50 degrees.

The first and second guiding surfaces can be flat or convexly single-curved.

Said engaging elements can along their longitudinal axis projecting from the mounting portion have a non-rotationally symmetrical cross section, which secures a proper orientation of the engaging elements in relation to the first axis during use.

The engaging elements can be pre-tensioned to return to their projected state after retraction. The pre-tensioning can be made by a resilient member.

The recess can have a surface adapted to interact with at least the second guiding surface of the engaging element facing the main body in order of causing a retraction of the engaging element along the second axis while displacing the dust collecting bin along the first axis away from the main body.

The mounting portion can further comprise a first guiding means and the dust collecting bin comprise a second guiding means, both extending along the first axis, wherein said guiding means are adapted to engage each other providing guiding of the dust collecting bin along said first axis during insertion and removal of the dust collecting bin.

DESCRIPTION OF DRAWINGS

The invention will now be described in more detail by way of example and with reference to the accompanying drawings.

TECHNICAL DESCRIPTION

In description to follow the terms "front" and "rear" will be used. The term "front" relates to a position facing away from the main body whereas the term "rear" relates to a position facing the main body.

The term "first axis" A relates to the direction in which the bin is adapted to be moved during insertion and removal from the mounting portion. In the disclosed embodiment the first axis extends in the horizontal plane, however it is to be understood that depending on the design of the mounting portion other planes are possible.

Figure 1:
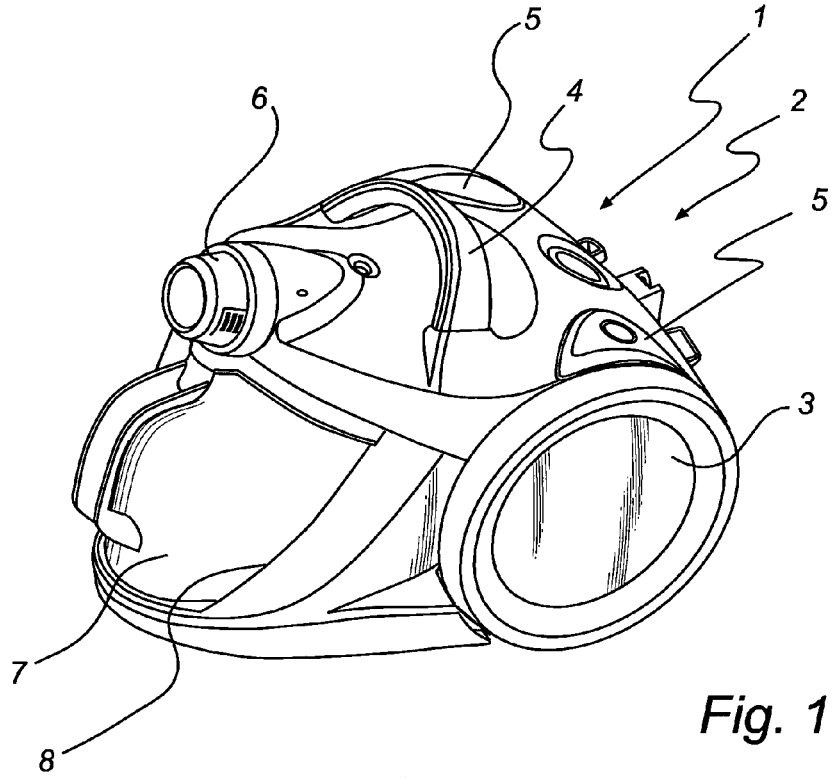
FIGS. 1 and 2 disclose one embodiment of a vacuum cleaner having a removable dust collecting bin in accordance with the present invention.
Figure 2:
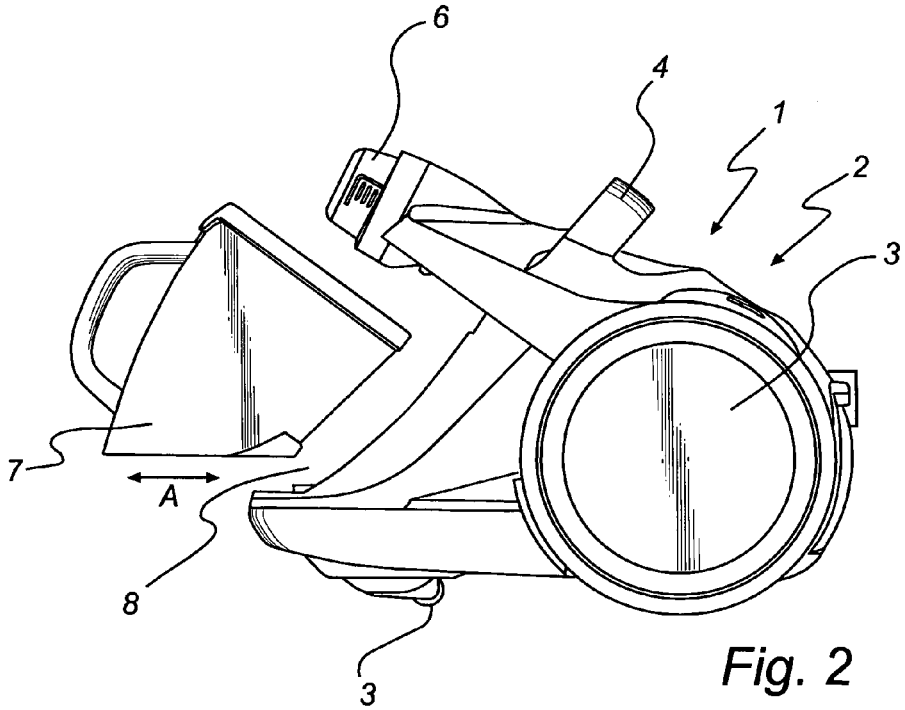

Referring to FIGS. 1 and 2, one embodiment of a vacuum cleaner 1 having a removable dust collecting bin in accordance with the present invention is disclosed without its hose. The vacuum cleaner 1 comprises a main body 2 supported by three wheels 3. On its upper surface a handle 4 is arranged for lifting the main body. On said surface operating means 5 for the cable reel and power are arranged, including a connecting means 6 for a hose (not disclosed).

In its front end, the vacuum cleaner comprises a dust collecting bin 7 which is removably mounted in a mounting portion 8 in the form of a cavity arranged in the main body 2. The dust collecting bin 7 will in the following be referred to as a bin. When mounted in the mounting portion 8, the bin 7 is communicating with a suction source passing the air via a separation unit formed by the bin, wherein the contaminants are separated and the air released. The separation can be made by a cyclonic action and/or by a filter.

Figure 3A:
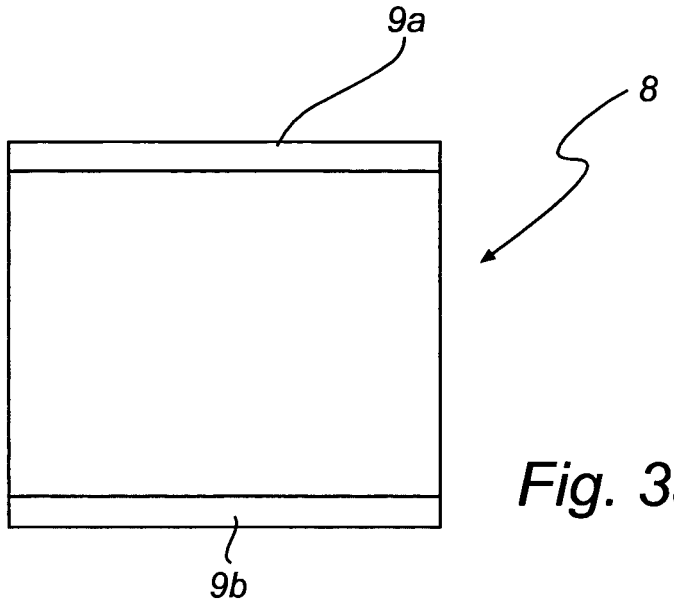
FIGS. 3*a*-3*c* schematically disclose different embodiments of the mounting portion.
Figure 3B:
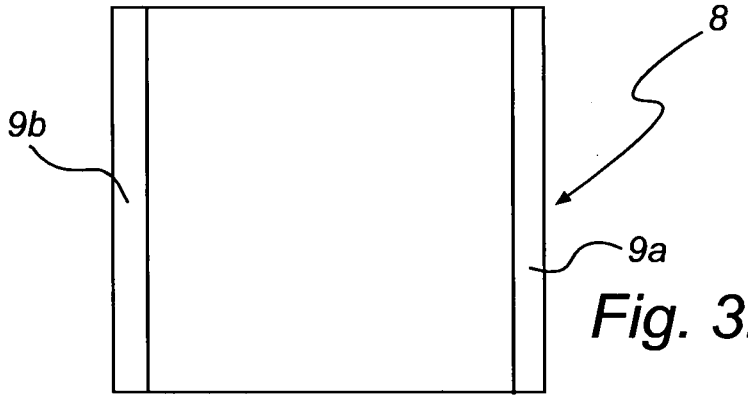
Figure 3C:
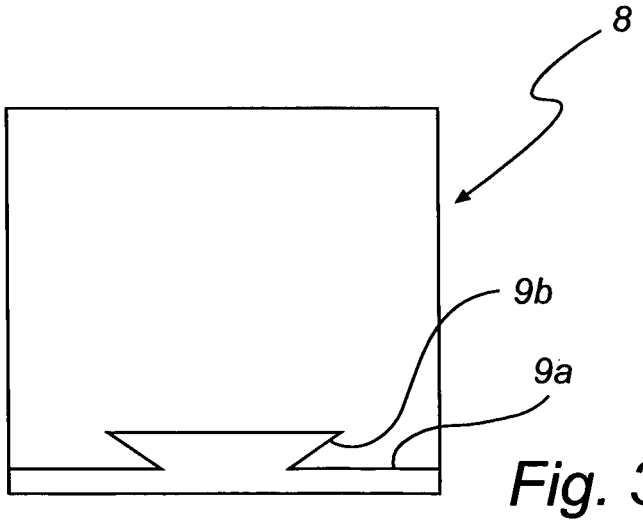

The mounting portion 8 can be formed in a number of different ways as long as it has a first 9*a* and a second 9*b* receiving surface 9 facing each other. Three examples are schematically disclosed in FIGS. 3*a*-3*c*. The facing receiving surfaces 9*a*, 9*b* can be two opposing surfaces forming a top and a bottom surface, see FIG. 3*a*, or two up-right standing surfaces 9*a*, 9*b* facing each other, see FIG. 3*b*. Further, they can be arranged as two interconnected surfaces 9*a*, 9*b* forming an angle λ therebetween resulting in a dove-tailed shape, see FIG. 3*c*. In the latter case, the dust collecting bin should in its mating bin surface have a corresponding shape.

Figure 4A:
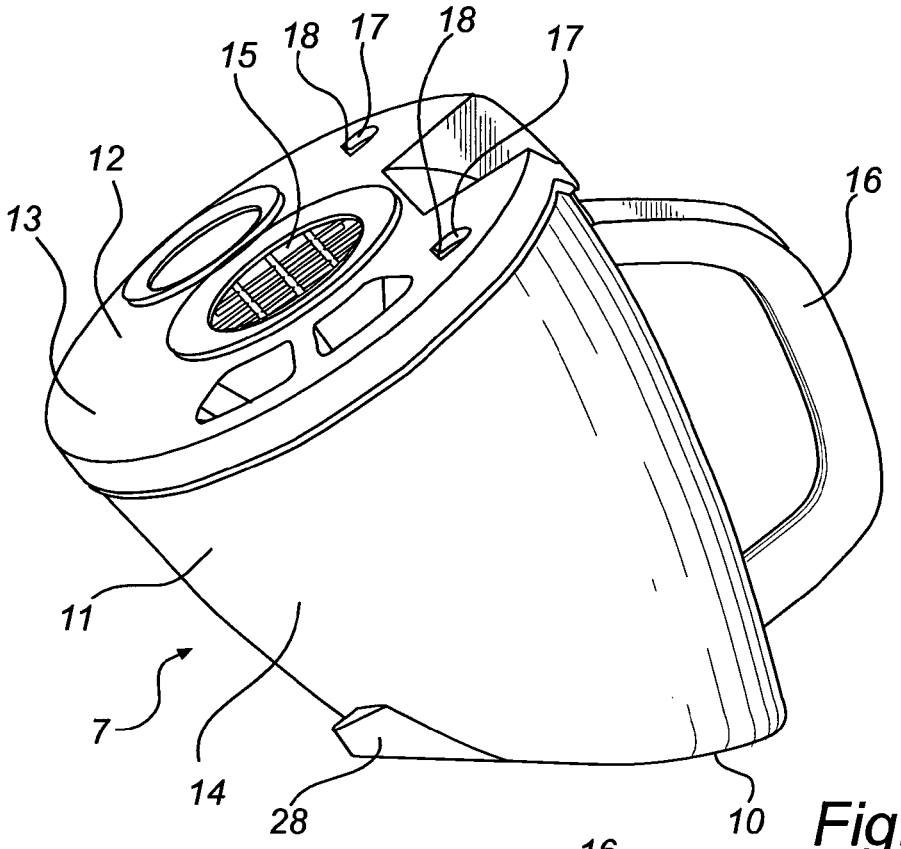
FIGS. 4*a* and 4*b* schematically disclose one embodiment of the dust collecting bin seen from the side and the bottom respectively.
Figure 4B:
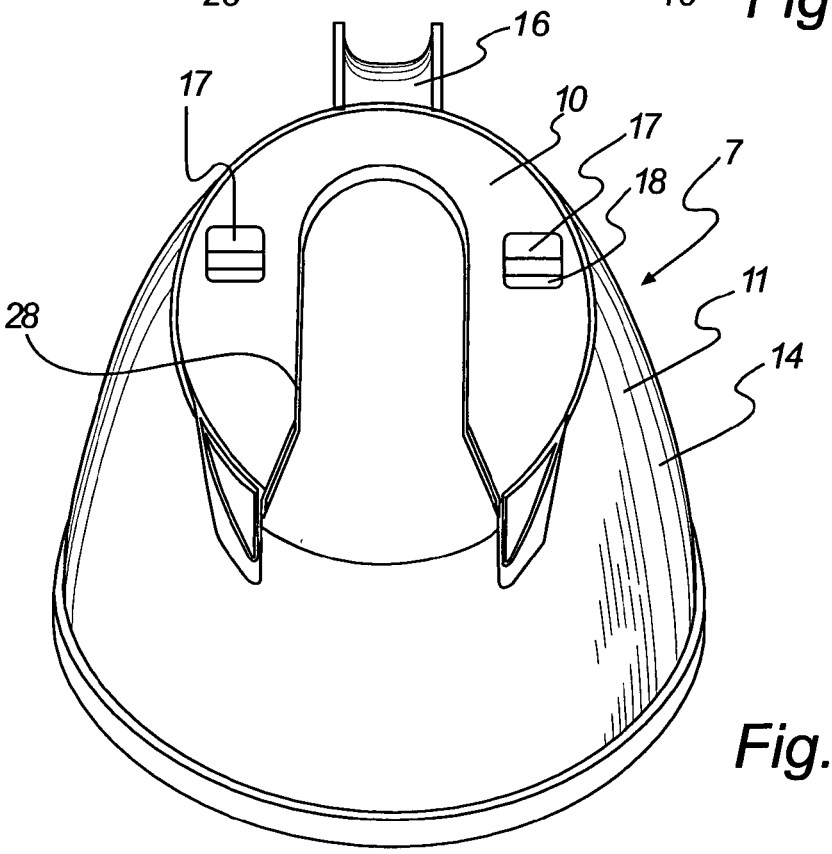

Now turning to FIGS. 4*a* and 4*b*, the bin 7 has the form of a pot with a closed bottom surface 10 and a cylindrical sidewall 11. A removable lid 12 closes the upper opening and thereby forms a top surface 13. The bottom surface 10, the cylindrical side wall 11 and the top surface 13 are referred to as bin surfaces 14. When mounted in the mounting portion, the bin 7 communicates with the cyclone body via a hole 15 in the lid 12. In the disclosed embodiment the hole 15 is covered by a grid. To facilitate handling, the bin has a handle 16 facing away from the main body.

In the bottom surface 10 and on the top surface 13 a number of recesses 17 are arranged. The number corresponds to the number of engaging elements in the mounting portion, which elements will be discussed below. The recesses 17 have in their rear end 18 a surface adapted to interact with at least a front guiding surface of the engaging element, which interaction will be discussed later.

Figure 5:
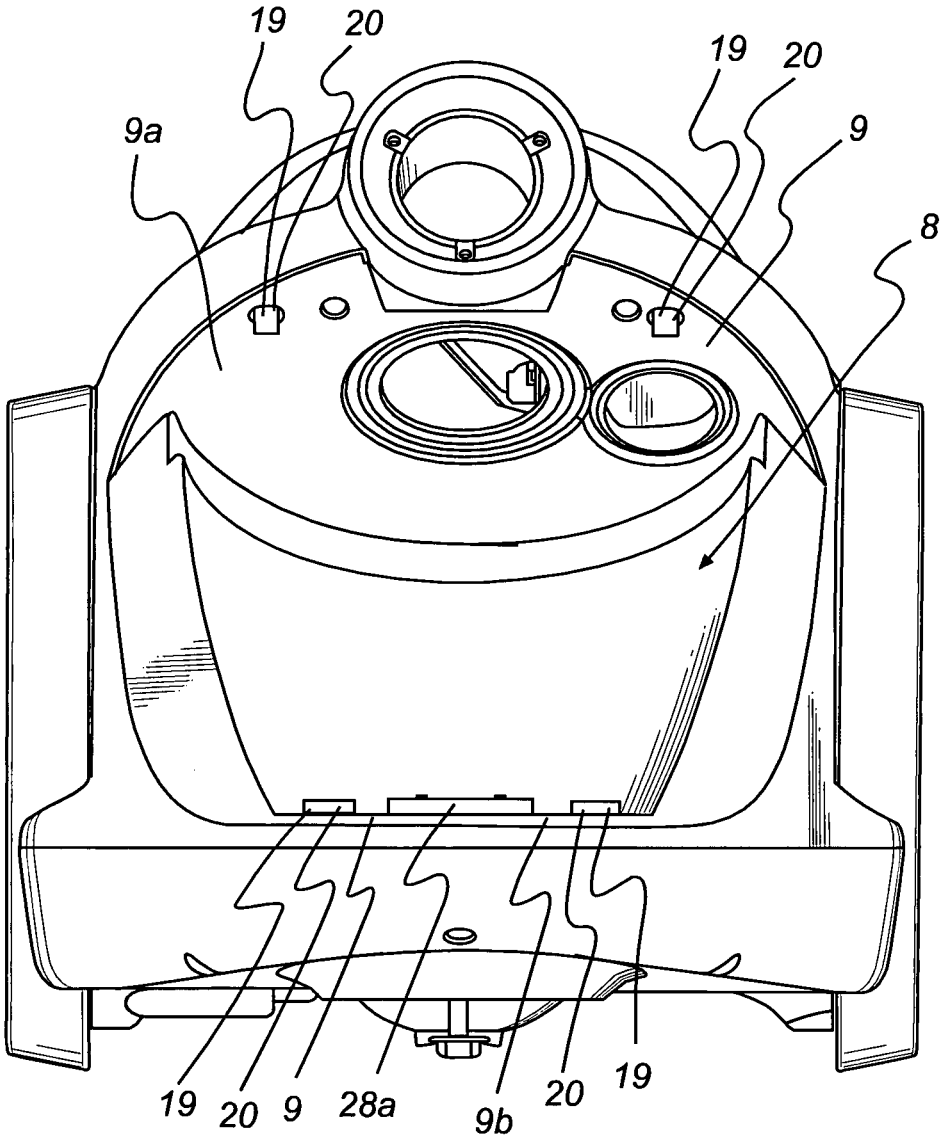
FIG. 5 discloses one embodiment of the mounting portion and its engaging elements.

Now turning to FIG. 5, the mounting portion 8 is disclosed schematically The mounting portion 8 has locking means 19 in the form of engaging elements 20 on its two receiving surfaces 9 formed by the bottom surface and the top surface of the mounting portion. In the disclosed embodiment two engaging elements 20 are arranged on the bottom surface and two engaging elements are arranged on the top surface. Each engaging element 20 is projecting from its respective receiving surface 9. The engaging elements 20 have a longitudinal extension and cross section along their axis projecting from their respective receiving surfaces corresponding to that of the recesses arranged in the bin that will be discussed below. The longitudinal extension is preferably perpendicular to the first axis A, but it is to be understood that an angle there to can be used. As disclosed in FIG. 5, the upper and lower engaging elements can have different sizes.

Figure 6A:
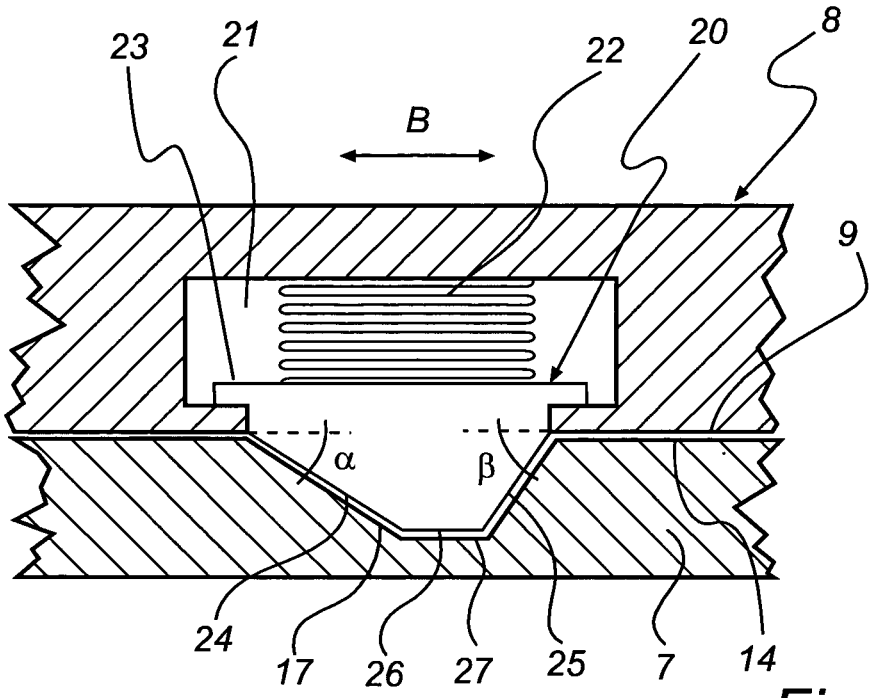
FIGS. 6*a* and 6*b* schematically disclose one embodiment of the engaging element cooperating with a recess.
Figure 6B:
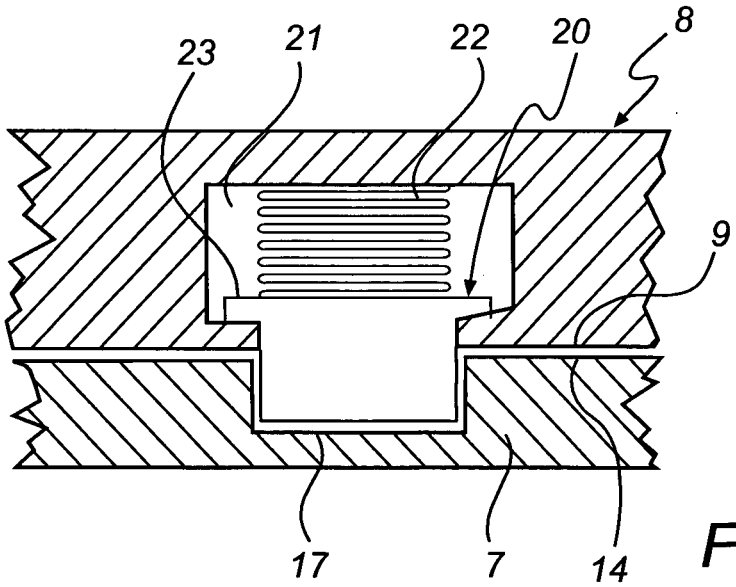

Now turning to FIGS. 6*a* and 6*b* an engaging element 20 is schematically disclosed seen from two different directions. The engaging element 20 is received in a pocket 21 formed in the corresponding receiving surface 9 of the mounting portion 8. More precisely, the engaging element 20 is biased by a resilient member 22 in a direction out from the pocket 21. In its neutral position the engaging element 20 is projecting away from its corresponding receiving surface 9 in the mounting portion 8. The resilient member 22 can be any item suitable for the purpose of causing a biasing such as a helical spring, a plate spring or an elastically deformable material such as rubber. The engaging element 20 is in the disclosed embodiment prevented from falling out of the pocket by a flange 23. Further, the engaging element 20 has a non-rotationally symmetrical cross section ensuring a correct orientation in the pocket 21 and especially in relation to the recesses formed in the bin surfaces as will be discussed below.

On its free edge, see FIG. 6*a*, each engaging element is provided with a first front guiding surface 24 facing away from the main body and a second rear guiding surface 25 facing the main body. An intermediate guiding surface 26 is arranged there between. The front and rear guiding surfaces 24, 25 do each form an angle $\alpha,\beta$ in relation to a horizontal plane B. The angle $\alpha$ formed by the front guiding surface 24 is smaller than the angle $\beta$ formed by the rear guiding surface 25.

The engaging elements 20 are movably received in the pockets 21 to allow insertion or removal of the bin 7 while a bin surface 14 is in sliding engagement with the intermediate surface 26.

More precisely, the front guiding surface 24 forms an angle $\alpha$ of 15-35 degrees in relation to said horizontal plane B. The rear guiding surface 25 forms an angle $\beta$ of 30-70 degrees and more preferably in the range of 40-50 degrees in relation to said horizontal plane B.

In the disclosed embodiment the guiding surfaces 24, 25, 26 are disclosed as flat surfaces, however, with maintained function the guiding surfaces can be arranged as convex single-curved surfaces having the same or different radius.

When a bin 7 is inserted in the mounting portion, the engaging element 20 is projecting into the recess 17 arranged in the bin surface 14 keeping the bin in place. The recess 17 has in the disclosed embodiment an inner envelope surface 27 complementary to that of the engaging element 20.

To provide a linear guiding of the bin 7 during insertion and removal from the mounting portion 8, the mounting portion and the bin are both provided with guiding means 28, see FIGS. 4*b* and 5, It is to be understood that such guiding means can take a number of different shapes and that the embodiment discussed below is only one out of many possible.

Figure 7A:
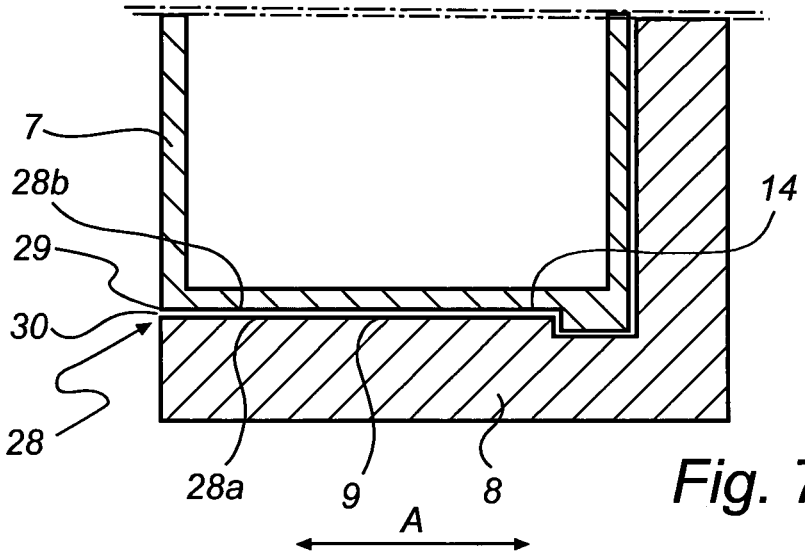
FIGS. 7*a* and 7*b* schematically disclose one embodiment of the guiding means.
Figure 7B:
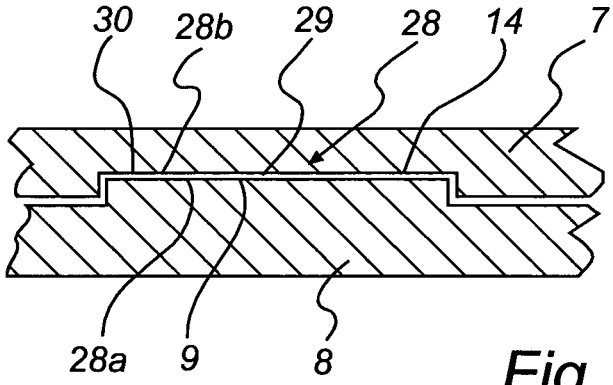

In FIGS. 7*a* and 7*b* disclosing the guiding means 28 seen from two different directions, the bottom receiving surface 9 of the mounting portion 8 is provided with a first guiding means 28*a* in the form of a projecting ridge extending along the first axis A. A corresponding recess 29 is formed in the bottom bin surface 14 forming a second guiding means 28*b*. The first and second guiding means 28*a*, 28*b* thus form a male and female profile allowing engagement and longitudinal movement in relation to each other along said first axis A. It is to be understood that with remained function the guiding means 28*a* in the mounting portion can form the female part whereas the guiding means 28*b* in the bin 7 can form the male part. Correspondingly, with remained function, said first and second guiding means 28*a*, 28*b* can be arranged in the envelope surface connecting the top and bottom surfaces of the bin 7 and the mounting portion 8, respectively as long as a linear guiding is provided along said first axis A. The female guiding means 28*b* has an opening 30 facing away from the main body.

The cross section of each of the first and second guiding means 28*a*, 28*b* can be uniform or be tapering towards the front end.

In the following, the insertion and removal of the bin will be described with reference to FIGS. 8*a*-8*c*. For illustration purpose, only the top bin surface 13 is disclosed and thus only one upper engaging element 20.

The bin 7 is inserted into the mounting portion 8 with a linear movement along the first axis A. During this movement the first and second guiding means 28*a*, 28*b* will mate forming a linear guiding between the bin and the mounting portion, see FIGS. 7*a* and 7*b*.

Figure 8A:
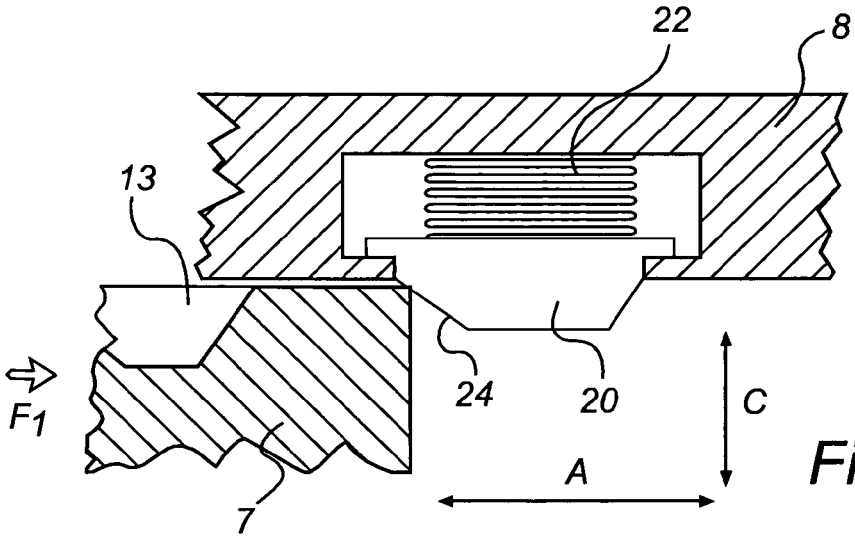
FIGS. 8*a*-8*c* schematically disclose the insertion of the bin.
Figure 8B:
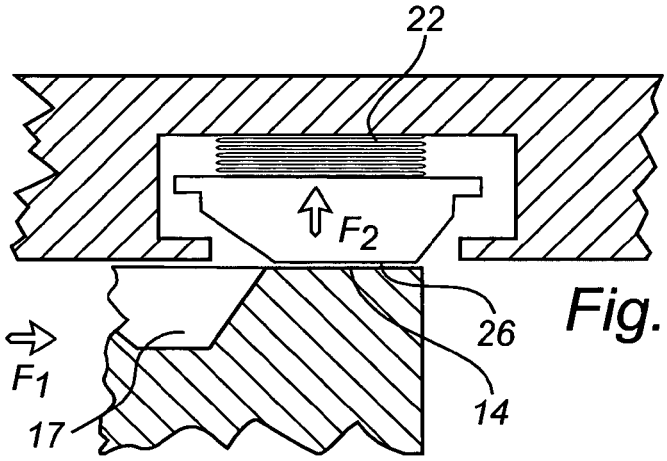
Figure 8C:
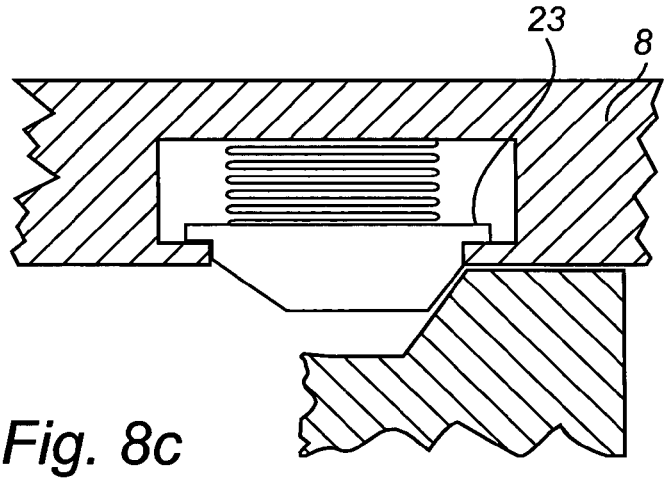

During the movement, see FIG. 8*a*, a portion of the bin 7 will initially contact the front guiding surface 24 of the engaging element 20. By the angled surface, the linear pushing force F1 applied by the operator along the first axis A is converted into a linear force F2 acting along the second axis C1 perpendicular to the first axis A. The latter force F2 compresses said resilient member 22 causing a retraction of the engaging element 20 allowing insertion of the bin 7, see FIG. 8*b*. During continued insertion the intermediate surface 26 abuts the bin surface 14 providing a sliding movement there between.

As the insertion progresses, the recess 17 in the bin surface 14 will reach the engaging element 20 whereby the compression is released to the extent permitted by the flanges 23 of the engaging element 20 and the engaging element will return to its projecting state. Thus, the engaging element 20 is received in the recess 17, see FIG. 8*c*, preventing further insertion of the bin 7 and also locking the bin in a correct position in the mounting portion 8. In this position a correct communication between the bin and the cyclone body (not disclosed) is ensured. During the insertion movement any misalignment between the bin and the mounting portion is prevented by the guiding means. In the mounted position the bin is prevented from movement along an axis C that is perpendicular to the axis A along which the bin is inserted. This applies no matter if the opposing receiving surfaces of the mounting portion are parallel or not. Thus, this applies also in the case the receiving surfaces are converging, forming a wedge shaped mouth of the mounting portion.

Figure 9A:
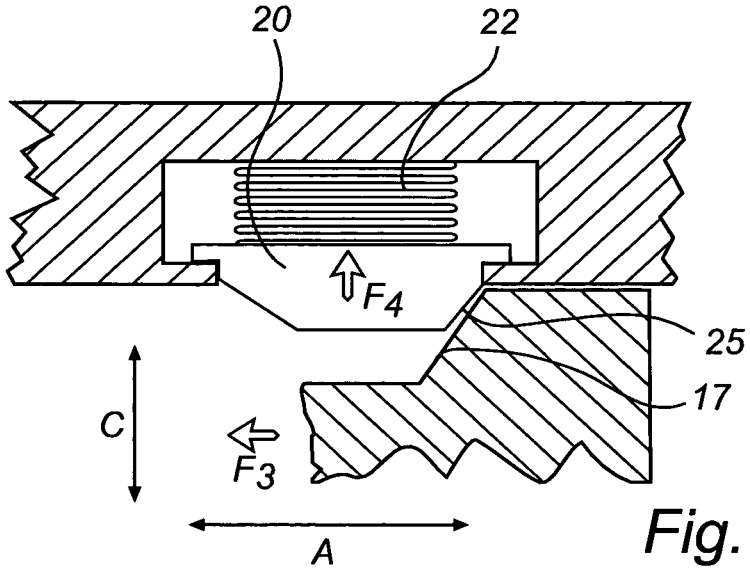
FIGS. 9*a*-9*c* schematically disclose the removal of the bin.
Figure 9B:
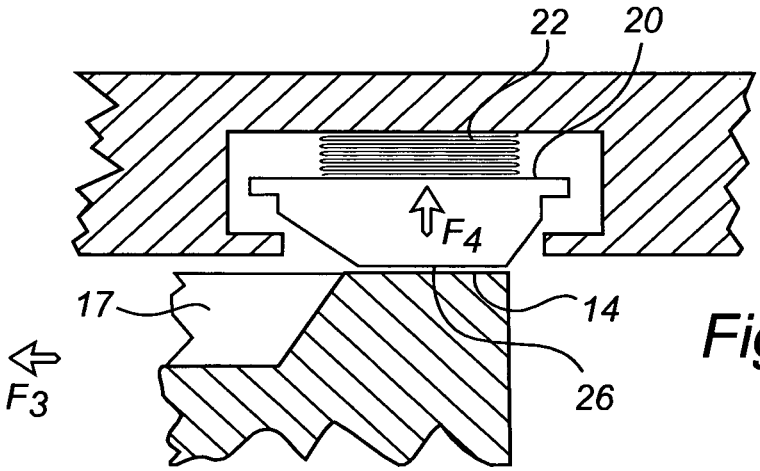
Figure 9C:
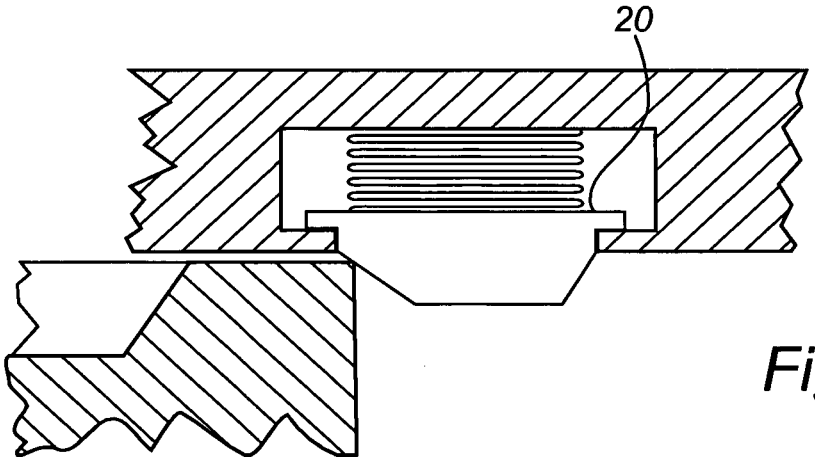

To remove the bin the operator applies a linear pulling force F3 along the first axis A. During this pulling the rear guiding surface 25 of the engaging element 20 will initially abut the corresponding rear guiding surface in the recess 17, see FIG. 9*a*. This abutting converts the applied linear pulling force F3 along the first axis into a linear retraction force F4 along the second axis C perpendicular to the first axis. The force F4 along the second axis C compresses the resilient member 22 and thereby retracts the engaging element 20 from the recess 17. Once exiting the recess 17 the engaging element 20 is sliding on the intermediate surface 26 along the bin surface 14, see FIG. 9*b*, until the bin 7 has been fully removed. The force F4 along the second axis is then relieved whereby the engaging element 20 returns to its projected normal state, see FIG. 9*c*.

Once the engaging element has exited the recess any misalignment between the bin and the mounting portion is prevented by the guiding means.

Now referring to FIG. 6*a*, by choosing an angle $\beta$ between the rear guiding surface 25 and the horizontal plane B, that is different from the angle $\alpha$ between the front guiding surface 24 and said horizontal plane, the force F1 required to insert the bin, i.e. to retract the engaging element, can be set to be different from the force F3 required to remove the bin.

In the present case where the angle α of the front guiding surface 24 is smaller than the angle β of the rear guiding surface 25, the force F1 required to insert the bin 7 is smaller than the force F3 required to remove the bin.

The above disclosure refers to one embodiment only and it is to be understood that a number of solutions are possible.

By way of example it is to be understood that the first and second guiding surfaces of the engaging elements can have the opposite angle condition than that disclosed above, i.e. the angle α formed by the first guiding surface in relation to the horizontal plane being larger than the corresponding angle β formed by the second guiding surface. Alternatively the angles α, β can be made the same. Also, it is to be understood that the engaging elements arranged on a first receiving surface do not have to be identical with those arranged on a second opposing receiving surface. Thus, in one embodiment the upper receiving surface can have engaging elements where the first and second guiding surfaces form the same angle in relation to the horizontal plane, whereas the lower receiving surface can have engaging elements where the first and second guiding surfaces form different angles in relation to the horizontal plane.

The engaging elements can have different geometries and also different extent of projection from their respective receiving surfaces of the mounting portion.

In the disclosed embodiment engaging elements have been arranged in both the top and bottom receiving surfaces of the mounting portion, however it is to be understood that with remained function they can be arranged in either the top or bottom receiving surface only. Alternatively they can be arranged in any up-right standing receiving surfaces of the mounting portion. Also one element or more than two elements can be arranged in each surface.

Also it is to be understood that the force required to insert or remove the bin is in addition to the angle dependent on the strength of any resilient means pre-tensioning the engaging elements.

The force required to remove the bin should preferably be considerably lower than that required to lift the main body in order of securing that the bin handle cannot be used to lift the vacuum cleaner.

The first axis must not extend in the horizontal plane. Also other planes are possible depending on the design of the mounting portion.

In the case engaging elements are arranged on a downwards facing receiving surface of the mounting portion such engaging elements can be adapted to return to their projected state by gravity only.

The engaging element has been disclosed as a wedge shaped body but it is understood that it can also have the form of a spherical body or a cylinder shaped body, the latter extending longitudinally in the same plane as the first axis but in a direction perpendicular thereto.

The envelope surface of the recess must not be complementary to that of the corresponding engaging element, but must have a surface adapted to cooperate with at least the rear guiding surface of the engaging element to convert the force along the first axis to a force along the second axis.

Accordingly it will be appreciated that the present invention is not limited to the disclosed embodiment. Several modifications and variants are thus conceivable, and consequently the invention is defined exclusively by the appended claims.

The invention claimed is:

1. A vacuum cleaner having a main body and a dust collecting bin, said dust collecting bin being removably mounted in a mounting portion of the main body and having two bin surfaces facing away from each other, and said mounting portion having two receiving surfaces facing each other and a locking means for securing the mounted dust collecting bin, characterized in that said locking means comprises:

at least one engaging element arranged in at least one of said receiving surfaces of the mounting portion and projecting therefrom, the at least one engaging element comprising a first guiding surface facing away from the main body and a second guiding surface facing the main body, wherein seen in a horizontal plane the first guiding surface forms an angle to that plane that differs from an angle to that plane formed by the second guiding surface, and the second guiding surface forms an angle of 30-70 degrees in relation to the horizontal plane, and said dust collecting bin having at least one recess in at least one of said bin surfaces for receiving said at least one engaging element in the mounted state of the dust collecting bin, and said at least one engaging element being retractable allowing insertion and removal of said dust collecting bin by displacement along a first axis, and said receiving surfaces of the mounting portion preventing movement of the dust collecting bin along a second axis perpendicular to the first axis.

2. Vacuum cleaner according to claim 1, wherein the at least one engaging element is retractable upon application of a force by said dust collecting bin along the first axis.

3. Vacuum cleaner according to claim 1, wherein at least one of the at least one engaging element in one of said two receiving surfaces facing each other has a first geometry, wherein the other of said two receiving surfaces facing each other has at least one engaging element having a second geometry that is different from the first geometry.

4. Vacuum cleaner according to claim 1, wherein the first guiding surface forms an angle of 15-35 degrees in relation to the horizontal plane.

5. Vacuum cleaner according to claim 1, wherein the first and second guiding surfaces are flat or convexly single-curved.

6. Vacuum cleaner according to claim 1, wherein each of the at least one engaging element has a non-symmetrical cross section along its longitudinal axis projecting from the mounting portion.

7. Vacuum cleaner according to claim 1, wherein each of the at least one engaging element is pre-tensioned to return to its projected state after retraction.

8. Vacuum cleaner according to claim 7, wherein each of the at least one engaging element is pre-tensioned by a resilient member.

9. Vacuum cleaner according to claim 1, wherein at least one of the at least one recess has a surface adapted to interact with at least the second guiding surface of the at least one of the at least one engaging element in order of causing a retraction of the at least one of the at least one engaging element along the second axis while displacing the dust collecting bin along the first axis away from the main body.

10. Vacuum cleaner according to claim 1, wherein the mounting portion further comprises a first guiding means and the dust collecting bin comprises a second guiding means, both extending along the first axis, wherein said guiding means are adapted to engage each other providing guiding of the dust collecting bin along said first axis during insertion and removal of the dust collecting bin.

11. Vacuum cleaner according to claim 1, wherein the second guiding surface forms an angle of 40-50 degrees in relation to the horizontal plane.

12. Vacuum cleaner according to claim 1, wherein the angles formed by the first and second engaging elements in relation to the horizontal plane are 40-50 degrees.

13. Vacuum cleaner according to claim 1, wherein the first guiding surface is connected to the second guiding surface by an intermediate guiding surface that is substantially parallel to the horizontal plane.

* * * * *